United States Patent [19]

Masui et al.

[11] Patent Number: 4,528,830

[45] Date of Patent: Jul. 16, 1985

[54] METHOD FOR CHANGING WIDTHWISE DISTRIBUTION OF THICKNESS OF METAL STRIP

[75] Inventors: Takeshi Masui; Junsuke Nakano, both of Hyogo, Japan

[73] Assignee: Sumitomo Metal Industries, Ltd., Osaka, Japan

[21] Appl. No.: 507,137

[22] Filed: Jun. 23, 1983

[30] Foreign Application Priority Data

Jun. 30, 1982 [JP] Japan ..... 57-111794
Oct. 21, 1982 [JP] Japan ..... 57-185271
Nov. 9, 1982 [JP] Japan ..... 57-196581

[51] Int. Cl.[3] ..... B21B 37/02; B21D 1/05

[52] U.S. Cl. ..... 72/16; 72/160; 72/161; 72/183

[58] Field of Search ..... 72/161, 160, 163, 177, 72/183, 54, 16

[56] References Cited

U.S. PATENT DOCUMENTS 2,275,095 3/1942 Thaden ..... 72/160
3,076,492 2/1963 Monks ..... 72/54
3,429,164 2/1969 Organowski et al. ..... 72/161
3,535,902 10/1970 Sevenich et al. ..... 72/161
3,812,697 5/1974 Kawaguchi et al. ..... 72/160
4,299,103 11/1981 Marten ..... 72/16

FOREIGN PATENT DOCUMENTS 1276490 10/1961 France ..... 72/160
122629 9/1980 Japan ..... 72/160

OTHER PUBLICATIONS

Sheehan, J. M., "Tension Leveling-All Electric Drive Concept," from *Iron and Steel Engineer,* Jun. 1978, pp. 43–46.

*Primary Examiner*—Daniel C. Crane
*Attorney, Agent, or Firm*—Burns, Doane, Swecker & Mathis

[57] ABSTRACT

A widthwise distribution of thickness of a metal strip is changed by passing the metal strip through a tool train including a plurality of tools disposed in zigzag and applying a bending under tension to the metal strip in the lengthwise direction thereof. A widthwise bending of the metal strip may be performed at the same time with said bending under tension, and a light reduction rolling of the metal strip may be performed before said bending under tension.

31 Claims, 32 Drawing Figures

Fig. 7
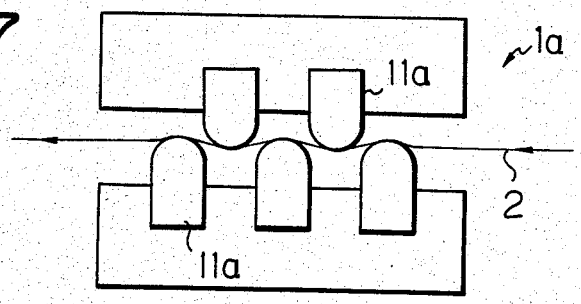
Fig. 8
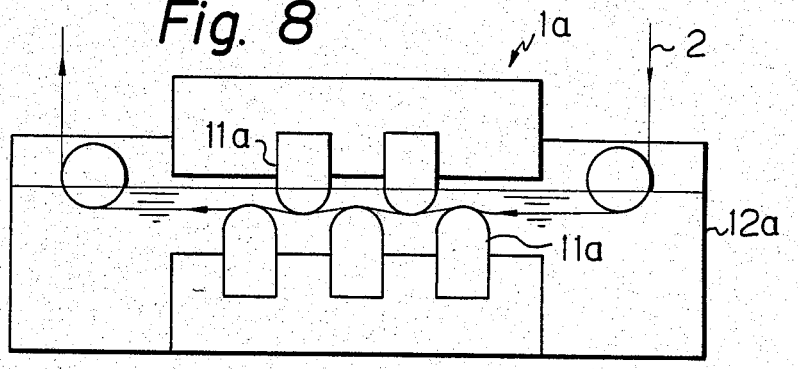
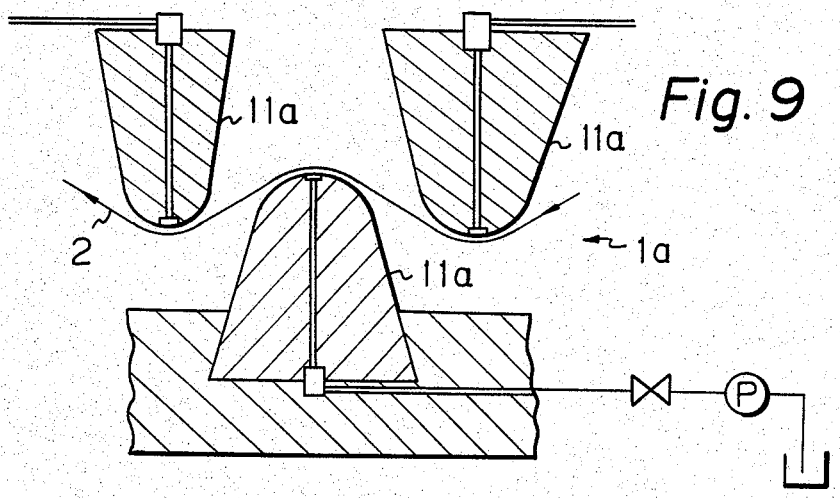
Fig. 9

Fig. 10(A)
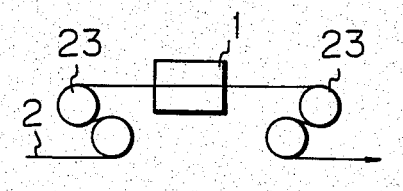
Fig. 10(B)
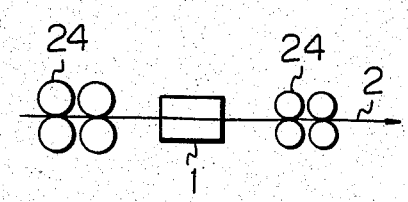
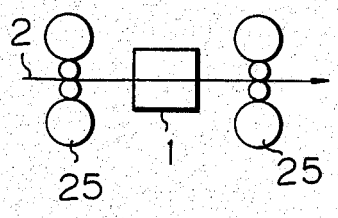
Fig. 10(C)
Fig. 11
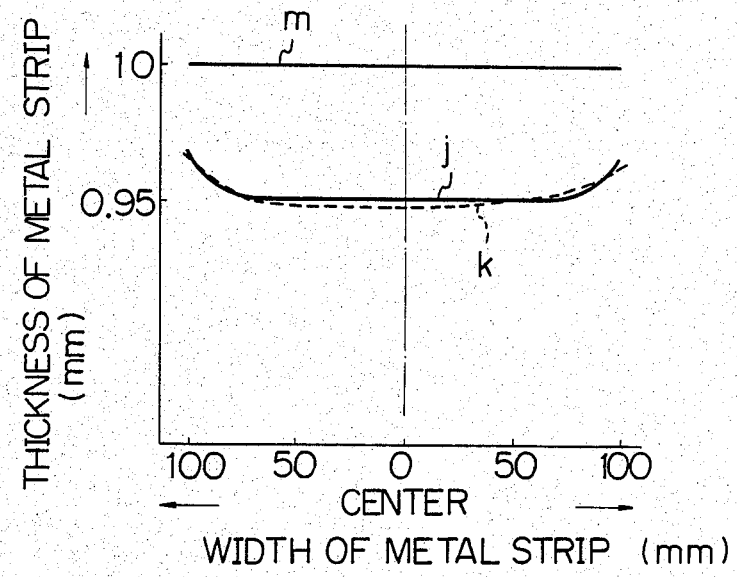

METHOD FOR CHANGING WIDTHWISE DISTRIBUTION OF THICKNESS OF METAL STRIP

BACKGROUND OF THE INVENTION

The present invention relates generally to a method for changing widthwise distribution of thickness of a metal strip and, more particularly, to a method for correcting cross-sectional profile such as crown, edge drop or the like and flatness of a strip of such metal as steel, copper, aluminum, or the like, and for working the metal strip into a special sectional profile.

Generally, flatness of a rolled material such as a metal strip or the like denotes a shape such as center buckle, wavy edge, waving or the like and overall lengthwise or widthwise curve, crown of a rolled material denotes a profile of a cross section of the material, and the thinning inclination in the widthwise edges of the material is particularly referred to as edge drop.

In recent years, the requirements for accuracy of flatness and crown of rolled products such as steel strip and the like have become very strict. In conventional rolling mills, while the lengthwise thickness of rolled material can be controlled relatively accurately by an automatic thickness control device, control of the widthwise thickness of the material is limited since it is performed by a roll bender.

Accordingly, as means for increasing accuracy of crown and shape of the material in place of the roll bender, a rolling mill having axially movable rolls and a rolling mill having variable-crown rolls have been developed. The former rolling mill has six-high rolls, intermediate rolls of which are axially oppositely movable to control the backing up force of the work rolls. The latter rolling mill comprises a pressure receiving chamber between the arbor and the sleeve of a roll, into which a pressure medium is introduced to regulate the pressure of the medium, thereby controlling the value of crowning of the roll.

These conventional techniques are means for improving rolling mills to increase the capacity of controlling the roll deflection and for minimizing the crown of the material (rather small in quantity, that is in the range of 0.5% to 2% of the thickness). However, these conventional techniques have limit and are unable to produce perfectly rectangular section. Further, decreasing of crown of the material causes wandering of the material which presents a problem of unstable operation. Furthermore, in the rolling mills, while crown of the material can be reduced to some extent since the deflection of the rolls is reduced, it is impossible to eliminate the edge drop. Furthermore, reconstruction of the rolling mill requires a large amount of investment.

An inexpensive method for correcting crown of material which can be conceived is to reduce the crowned portion of the rolled material by light reduction rolling to control the section of the rolled material into a rectangular shape. In this method, however, the shape of the rolled material will be extremely worsened to make the rolling operation impossible.

Edge drop will now be described. Generally, a rolled material shows a tendency of a sudden decrease in thickness in the region of 10 mm to 50 mm from the edges thereof. This edge drop is considerably large and, for example, in a hot strip of steel, it can be as large as 0.1 mm. Therefore, in steel sheets such as hot strip and cold strip, it is frequently necessary to trim edges or neighborhood thereof, thereby causing decrease in yield.

It can be said that the existing production lines are left as they are, without any particular countermeasure being considered against the edge drop.

While several studies have been done to reduce the edge drop by devising a rolling method, they are, as will be explained in detail, technically ineffective or difficult to reduce to practice.

As another method for reducing edge drop, use of work rolls of a smaller diameter has been proposed. The purpose of this method is to reduce the flattening of the roll by reducing the rolling load, to thereby reduce the edge drop. In this method, however, the line speed is decreased and the unit consumption of the roll is worsened. Further, the effect of this method is small because it is impossible to eliminate edge drop completely.

As still another method, use of work rolls with tapered ends has been proposed. The purpose of this method is to decrease the reduction of the edge portions of the rolled material by providing the work rolls with taper. In this method, however, it becomes necessary to change rolls every time the width of the material is changed and the desired effect is not obtained when wear of the rolls proceeds.

A tension leveler closely connected to the present invention will now be described. Shape defect, such as center buckle and wavy edge, of material are due to difference in lengthwise elongation of the material and, accordingly, cannot be corrected unless the material is provided with plastic elongation.

The tension leveler is designed to correct shape defects by providing plastic elongation to the material with bending under tension. The difference in elongation of the material by a rolling mill is usually at most in the order of 0.1%, by which shape defects such as center buckle and wavy edge are produced. By elongating this to the order of 0.2% to 0.5% by the tension leveler the material is flattened. The conventional tension levelers are designed to provide the maximum percentage of elongation in the order of 1% to 1.5%. Since it is used usually in the lowest required percentage of elongation, reduction in thickness or width of the material by the tension leveler is very small and practically neglected. In the conventional method, after all, there is no idea of correcting crown of the rolled material using the tension leveler.

SUMMARY OF THE INVENTION

A general object of the present invention is to provide a method for changing widthwise distribution of thickness of a metal strip inexpensively and accurately.

A specific object of the present invention is to provide a method for correcting sectional profile such as crown or edge drop and flatness of a metal strip.

Another specific object of the present invention is to provide a method for working the section of a metal strip into a special profile as desired.

The basic method according to the present invention comprises the steps of passing the metal strip through a tool train including a plurality of tools disposed in zigzag, and applying a bending under tension to said metal strip in the lengthwise direction thereof when passing through said tool train to provide said metal strip with a lengthwise plastic elongation.

As a modification of the method according to the present invention, it is effective to add any of the following steps to said step of applying the lengthwise bending under tension:

(a) applying bending to the metal strip in the widthwise direction thereof at the same time with said bending under tension applying step;

(b) applying a light reduction rolling to the metal strip before said bending under tension applying step; and (c) applying a light reduction rolling to the metal strip before said bending under tension applying step and further applying bending to the metal strip in the widthwise direction thereof at the same time with said bending under tension applying step.

The lengthwise plastic elongation is so determined that the difference between the decrease in the maximum thickness and the decrease in the minimum thickness of the metal strip is 0.5% or larger of the maximum thickness of the metal strip on the entry side of said tool train.

The tool train used in the present invention is basically identical with a tension leveler which may be of any of such constructions in which driven or freely rotatable rolls are disposed in zigzag, stationary blocks (fixed type) are disposed in zigzag, and stationary blocks injecting pressurized fluid from the tops are disposed in zigzag.

In the method according to the present invention, it is possible to change the thickness distribution accurately by measuring the distribution of thickness of the metal strip on the entry or exit side or on both of the sides and regulating the lengthwise plastic elongation or the widthwise bending or both of them according to the measured value of the distribution.

In light reduction rolling, it is possible to change the thickness distribution accurately by measuring the distribution of thickness of the metal strip on the entry side of the light reduction or on the exit side of the tool train or on both of them, and regulating the lengthwise plastic elongation, widthwise bending, or rate of reduction of the metal strip, or combination of them according to the measured value of the distribution.

The method according to the present invention is applicable to strips of steel, copper, copper alloy, aluminum, aluminum alloy, titanium alloy, and any ductile metal which can be provided with plastic elongation without breaking by bending tensioning.

The widthwise bending step described above can be performed by any of the following means:

(a) means of deflecting at least one piece of tool of said tool train;

(b) means of forming a crown in at least one piece of tool of said tool train;

(c) means of pushing a back-up member against at least one piece of tool of said tool train and deflecting said tool;

(d) means of forming a crown only on one side of at least a pair of tools of said tool train, disposing said crowns on opposite sides, and moving said pair of tools axially in opposite directions according to the width of the metal strip; and (e) means of disposing another tool on the opposite side to at least one tool of said tool train with respect to the metal strip, and pushing the metal strip against said tool.

In widthwise bending, it is effective to vary the curvature widthwise instead of keeping the curvature along the widthwise direction. That is, it is effective to form the desired curvature at a desired position in the widthwise direction of the metal strip. In this case also, any of the means (a) to (e) can be utilized.

The light reduction rolling step described above may be performed either by rolling rolls disposed on the entry side of said tool trains or by a rolling mill disposed in some other place.

In order to increase the quantity of decrease of edge drop in using the rolling rolls, it is preferable to form a crown or a taper on one side of at least a pair of rolling rolls, to dispose said crowns or tapers on opposite sides, and to move said pair of rolling rolls axially in opposite directions to each other according to the width of the metal strip.

BRIEF DESCRIPTION OF THE DRAWINGS

The invention will be better understood from the following description taken in connection with the accompanying drawings in which:

FIG. 7 is a side view showing schematic construction of the stationary block type tension leveler;

FIG. 8 is a schematic side view showing a modification of the leveler of FIG. 7;

FIG. 9 is a schematic illustration of construction of essential portions of a tension leveler using a stationary block injecting a pressurized fluid from the top;

FIGS. 10A to 10C are schematic illustrations of methods for applying tension to the metal strip;

FIG. 11 is a graph showing a cross-sectional profile of the rolled material provided with a large plastic elongation;

DETAILED DESCRIPTION OF THE PREFERRED EMBODIMETNS

Figure 1:
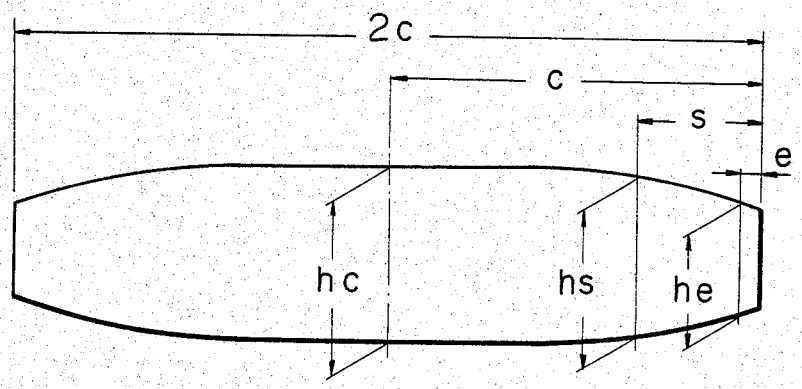
FIG. 1 is a cross-sectional view of a metal strip for illustrating edge drop and crown thereof.

Before describing the method according to the present invention, crown $(CR)_s$ and edge drop $(ED)_{s\text{-}e}$ of the metal strip used herein are defined as follows with reference to FIG. 1:

$$(CR)_s = h_c - h_s$$

$$(ED)_{s\text{-}e} = h_s - h_e$$

wherein, $h_c$: thickness at the central portion of the cross section of the metal strip of width 2c $h_s$: thickness of the metal strip at the position spaced by the distance S toward the center from the edge of the cross section thereof $h_e$: thickness of the metal strip at the position spaced by the distance e toward the center from the edge of the cross section thereof The present invention is based on the discovery by the inventors through experiments that bending under tension of a metal strip causes a phenomenon contrary to edge drop in rolling.

The experiments performed by the inventors will now be described in detail.

Figure 2:
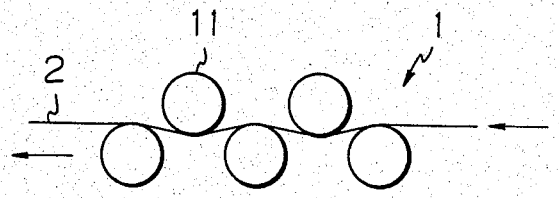
FIG. 2 is a schematic illustration of a common tension leveler to which the method according to the present invention is applied.

A cold-rolled steel strip 2 of 1.0 mm thickness and 200 mm width was subjected to bending under tension with varying value of intermesh and tensile force by a tension leveler 1 having five pieces of work rolls 11 of 50 mm diameter as shown in FIG. 2 to measure the percentage of elongation and thickness. To obtain a large percentage of elongation the steel strip 2 was passed through the tension leveler 1 a plurality of times. This was equivalent to a single passage through a tension leveler having a large number of rolls. The cold-rolled steel strip 2 used in the experiment was a slitted product having no edge drop and a uniform widthwise distribution of thickness before the experiment. This experiment revealed the following phenomena:

(1) While the thickness decreased as the elongation increased, the decrease of the thickness was small only in the neighborhood of the edges, thereby causing a phenomenon contrary to edge drop (hereinafter called "edge up"). The thickness decreased uniformly in the area 20 mm or more inside from the edges.

(2) As the elongation increased, the difference in thickness between the edges and the other portion than the neighborhood of the edges increased monotonously. That is, even when the thickness in the neighborhood of the edges was different from the thickness in the inner portion, the edge up proceeded as in the initial uniform thickness.

(3) Even when the values of intermesh and tensile force of the tension leveler were changed, by adjusting the number of passes (that is, the number of the rolls) of the tension leveler to make the total elongation equal, the edge up was caused to the same extent to make the distribution of thickness substantially same (with a small difference).

(4) The lengthwise elongation was uniform in the widthwise direction. Therefore, shape defect did not occur.

(5) Since the lengthwise elongation was uniform and the decrease in thickness was not uniform, the widthwise strain (reduction in width) was not uniform in the widthwise direction in view of the condition of constant volume of metal material in plastic deformation. The reduction in width was larger in the neighborhood of edges than in the inner portion.

Figure 3:
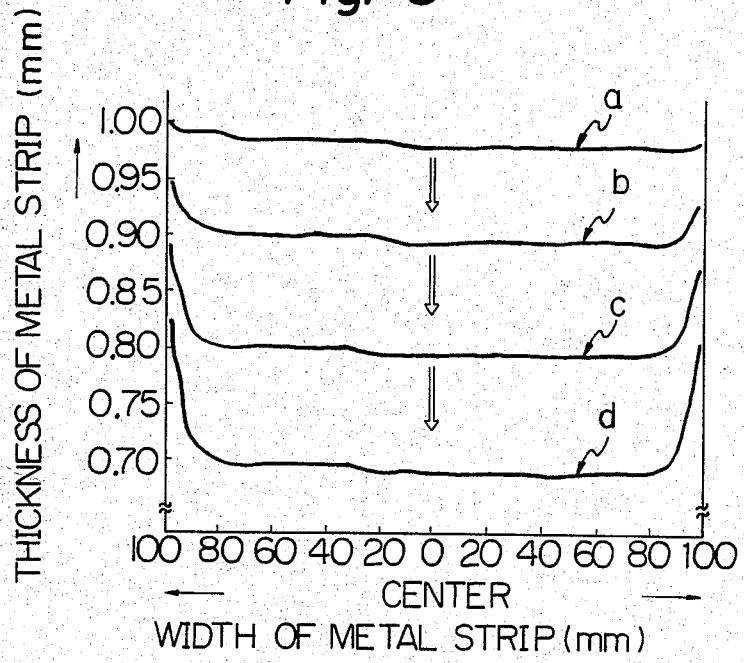
FIG. 3 is a graph showing experimental results of edge up phenomenon on which the present invention is based.

FIG. 3 shows examples of measurement of the distribution of thickness of a steel strip in the experiment mentioned above. In FIG. 3, the horizontal axis denotes the distance from the center of width of the steel strip and the vertical axis denotes the thickness of the steel strip. Curves a to d show as follows:

Curve a: distribution of thickness of the strip (cold-rolled coil) before pass

Figure 4:
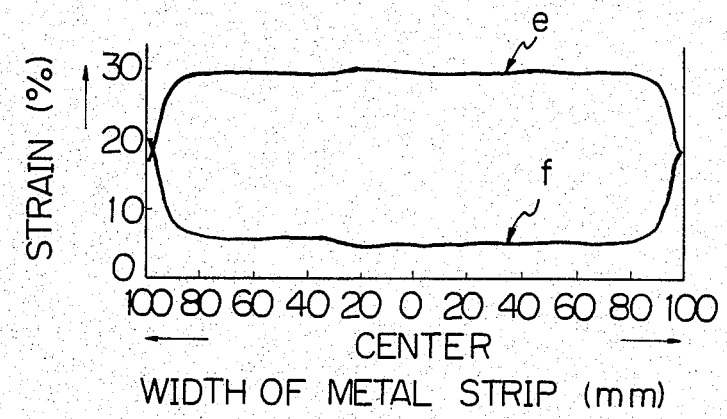
FIG. 4 is a graph in which the result of the curve d of FIG. 3 is converted into widthwise strain.

Curve b: distribution of thickness after passing 10 rolls with bending under tension Curve c: distribution of thickness after passing 30 rolls with bending under tension Curve d: distribution of thickness after passing 60 rolls with bending under tension From FIG. 3, phenomena (1) and (2) mentioned above are observed clearly. FIG. 4 shows graphically the widthwise strain computed from the measured values of elongation and thickness by the condition of constant volume and the rate of decrease of thickness.

The values of FIG. 4 were computed from the results of experiment of passes of 60 rolls shown in FIG. 3. In FIG. 4, curve e shows the thicknessiwise strain (decrease in thickness) and curve f shows the widthwise strain (decrease in width).

From FIG. 4, the phenomenon (5) mentioned above is observed clearly. Further, it is observed that the reduction in width was caused in the neighborhood of the edge in the same extent as the reduction in thickness and that in the region 20 mm or more inside of the edges the reduction in width is small and is close to a plane strain deformation.

Another experiment was conducted to confirm the edge drop correcting effect by the edge up phenomenon.

A hot-rolled steel strip of 2.3 mm thickness and 200 mm width (a slitted steel strip free from edge drop, that is, of substantially uniform thickness) was rolled at approximately 15% reduction rate and thereafter provided with approximately 5% plastic elongation by a tension leveler. Change in the thickness distribution in this case is shown in FIG. 5.

Figure 5:
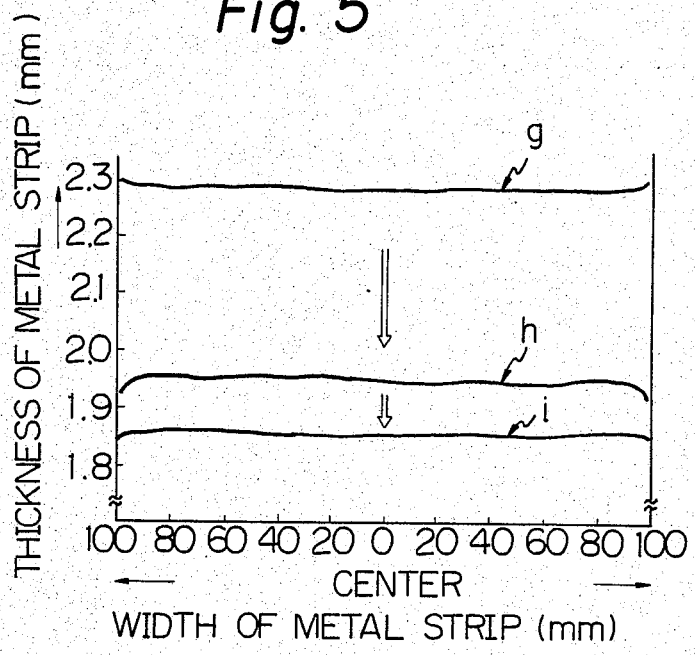
FIG. 5 is a graph showing results of examples of practice of the method according to the present invention.

In FIG. 5, the horizontal axis denotes the distance (mm) from the center of width of the steel strip and the vertical axis denotes the thickness (mm). Curve g shows the distribution of thickness of the steel strip before experiment, curve h shows the distribution of thickness after rolling, and curve i shows the distribution of thickness after bending under tension.

From FIG. 5 it is observed that the edge drop caused by rolling was almost eliminated by bending under tension using the tension leveler. In other words, it is made clear that the edge up phenomenon occurs in metal strips having edge drop as in metal strips free of the edge drop. In this particular example, since the region of edge drop coincided with the region of edge up and since the shape of edge drop corresponded complementarily with the shape of edge up, the neighborhood of the edges became substantially perfectly flat.

In the case where the region of edge drop does not coincide with the region of edge up, it is not possible to eliminate the edge drop completely. However, since there is usually no great difference between these two regions, it is possible to reduce the edge drop to a practically sufficiently effective extent by the method according to the present invention.

It has become clear that the phenomenon described above is universally recognized in various materials having widely different width, yield stress, modulus of elasticity and the like and in non-ferrous materials such as aluminum, copper and the like.

From the experimental results described above, it has been proved that edge drop can be cancelled almost completely by giving an adequate amount of plastic elongation by means of bending under tension.

The amount of plastic elongation required to cancel edge drop is dependent on such conditions as thickness of strip, quality of material, roll pitch and the like. The more markedly the edge up occurs, the smaller is the plastic elongation required. The inventors' experiments with various kinds of materials under various conditions have revealed that the amount of reduction of thickness of a strip in the region free of edge drop required to cancel the edge drop $(ED)_{s\text{-}e}=h_s-h_e=\delta$ (hereinafter called $\delta$) is in the range $1.5\delta\sim5\delta$. That is, it is required to give a plastic elongation resulting in reduction in thickness of the strip in the range $1.5\delta\sim5\delta$ by means of bending under tension. The percentage of this elongation is usually in the order of 2% to 10%. This percentage is considerably larger than the percentage of elongation 0.3%~0.5% in conventional tension levelers primarily for the purpose of correction of shape. This fact shows that the conventional tension leveling is considerably short of percentage of elongation for reduction of edge drop.

In order to cancel edge drop, the edge drop of the metal strip is measured or estimated and a plastic elongation is given so that the amount of reduction of thickness in the region free of edge drop is $a\times\delta$ ($a=1.5\sim5$). The value of a is predetermined experimentally since it varies depending on such conditions as the means for bending under tension, thickness of the strip and the like.

Practically, a large industrial significance is obtained simply by reducing edge drop by half. In such case, the amount of plastic elongation required is small. In the method according to the present invention, the amount of reduction of thickness and the amount of reduction of width must be taken into consideration since they are unneglectably large. This is true to the case to be described in detail where the widthwise bending is added.

Figure 6:
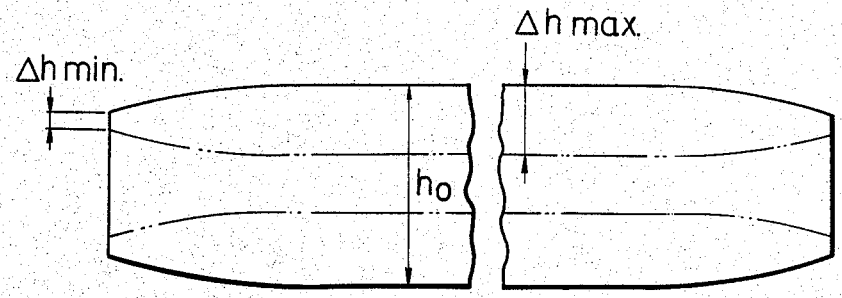
FIG. 6 is a cross-sectional view for illustrating the rate of change of the widthwise distribution of thickness of the metal strip.

Now, rate of change in a widthwise distribution of thickness of a metal strip will be described with reference to FIG. 6. In FIG. 6, solid line shows a cross section of a metal strip before application of bending under tension by the method according to the present invention and two-dot chain line shows the cross section of the metal strip after application of the bending under tension. In FIG. 6, $h_o$ denotes the maximum thickness of the metal strip before application of the bending under tension, $\Delta h_{max}$ denotes the maximum amount of reduction of the thickness, and $\Delta h_{min}$ denotes the maximum amount of reduction of the thickness.

For convenience of explanation, the rate of change of the widthwise distribution of thickness of the metal strip P is defined as follows:

$$P=(\Delta h_{max}-\Delta h_{min})/h_o$$

The method according to the present invention is characterized in that the rate of change P is determined to be 0.5% or higher for the reason described below.

In correction of shape defects by a conventional tension leveler, a small change in the widthwise distribution of thickness occurred. However, the largest percentage of elongation used in the conventional tension leveler was 0.5%. In this case, the rate of change P could not be 0.5% or larger. In the case where both the portion which was reduced 0.5% only in width without reducing in thickness at all and the portion which was reduced by 0.5% only in thickness without reducing in width existed, the rate of change P would be 0.5%. In fact, however, since there is no such possibility in bending under tension that only width is reduced with no reduction in thickness, the percentage of elongation of 0.5% cannot result in the rate of change P of 0.5%.

In view of the fact that the rate of change P is lower than 0.5% in the conventional tension leveler as described above and that the rate of change P lower than 0.5% is very insignificant in industry, the rate of change P is predetermined to 0.5% or higher in the method according to the present invention.

In the method according to the present invention, the tool train applying bending under tension to a metal strip is basically identical to a tension leveler. Accordingly, an apparatus incorporating the tool train according to the present invention for changing the widthwise distribution of thickness will be called a tension leveler in the ensuing description for convenience of explanation. A most common example of the tension leveler is of the construction in which driven or freely rotatable rolls 11 are disposed in zigzag as shown in FIG. 2. Another example of the tension leveler is of the construction shown in FIG. 7, in which stationary blocks 11*a* having adequate radius of curvature at the top are disposed in zigzag so tht metal strip 2 passes therethrough.

In this case, adequate lubrication between the stationary blocks 11*a* and the metal strip 2 is required to prevent occurrence of scratch. The means for lubrication may be of the system shown in FIG. 8, in which the stationary blocks 11*a* and the metal strip 2 are immersed in an oil tank 12*a*. Besides, the tension leveler of the system shown in FIG. 9 may be used, in which a pressurized fluid such as oil or water is injected from the tops of the stationary blocks 11*a* to form a film of lubricant between the stationary blocks 11*a* and the metal strip 2.

As means for applying tensile force to the metal strip 2, bridle rolls 23, pinch rolls 24, or rolling mills 25 or combination thereof may be disposed on the exit and the entry sides of the tension leveler 1 to which the method according to the present invention in applied, as shown in FIGS. 10A to 10C.

Now, the step for applying widthwise bending will be described in detail. First, an experiment of roll bending was performed to examine the effect of the widthwise bending. In this experiment using, as in the experiment described hereinabove, the common tension leveler 1 shown in FIG. 2, bending under tension was applied to the metal strip 2 to give it a plastic elongation of 5%. The specimen 2 used in this experiment was a cold rolled steel strip of 1.0 mm thickness and 200 mm width. The tension leveler 1 comprised eight pieces of rolls 11 of 20 mm diameter.

The bending under tension applied to the metal strip 2 under the condition described above produced the sectional profiles shown in FIG. 11, in which solid line m shows the sectional profile of the starting material (having a widthwise uniform thickness since it was a slitted material from a wide strip), solid line j shows the sectional profile of the strip not subjected to roll bending, and dotted line k shows the sectional profile of the strip subjected to roll bending.

As shown in FIG. 11, when a large plastic elongation was applied by the tension leveler to the metal strip not subjected to roll bending, the edge up phenomenon occurred as described hereinabove. The cause for occurrence of the edge up phenomenon is still being investigated and is presently presumed to be that since the edges of the metal strip are bent simultaneously lengthwise and widthwise while the metal strip is given bending under tension, the widthwise strain in the edges increases and the reduction of the thickness in the edges decreases.

In other words, according to the law of constant volume in plastic deformation of metal, the following formulas are valid:

(1) With respect to the widthwise central portion of a metal strip with only lengthwise bending but without widthwise bending:

$$\epsilon_3+\epsilon_b+\epsilon_h=0$$

where, $\epsilon_3$: lengthwise strain in the central portion of the metal strip $\epsilon_b$: widthwise strain in the central portion of the metal strip $\epsilon_h$: thicknesswise strain in the central portion of the metal strip (2) With respect to the widthwise edge portion of a metal strip with both of lengthwise bending and widthwise bending:

$$\epsilon'_e+\epsilon'_b+\epsilon'_h=0$$

where, $\epsilon'_e$: lengthwise strain in the edges of the metal strip $\epsilon'_b$: widthwise strain in the edges of the metal strip $\epsilon'_h$: thicknesswise strain in the edges of the metal strip While $\epsilon_e=\epsilon'_e$ in this experiment, the widthwise strain in the edges of the metal strip is increased by occurrence of the widthwise bending into $|\epsilon_b|<|\epsilon'_b|$. As the result, $|\epsilon_h|>|\epsilon'_h|$ (edge up) holds. The widthwise bending in the edges occurs because the metal strip is bent in the lengthwise direction and, therefore, the edge up phenomenon is not caused simply by applying tension.

In this experiment, it was actually observed that the edges were slightly detaching from the roll by occurrence of the widthwise bending in the edges.

Elimination of edge drop is made possible by utilizing the edge up as described above. However, this is limited to edges of a metal strip. Therefore, it will be easily estimated that control of crown of a metal strip is also made possible by growing the edge up as far as the widthwise central portion of the metal strip, that is, by causing the widthwise bending not only to the edges but also to the widthwise central portion of the metal strip. In fact, as shown by the dotted line k in FIG. 11, it has been made clear that control of crown is possible by performing roll bending and by causing the widthwise bending to penetrate as far as the widthwise central portion of the metal strip.

Figure 12:
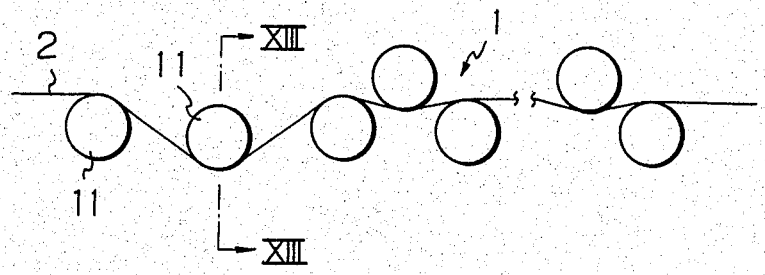
FIG. 12 is a schematic illustration of another tension leveler to which the method according to the present invention is applied.
Figure 13:
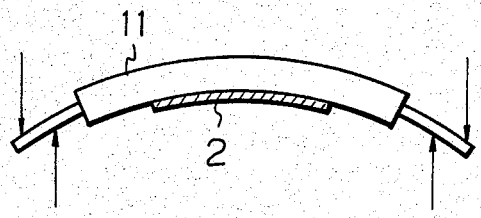
FIG. 13 is a front view of the tension leveler taken along the line XIII—XIII of FIG. 12.
Figure 14:
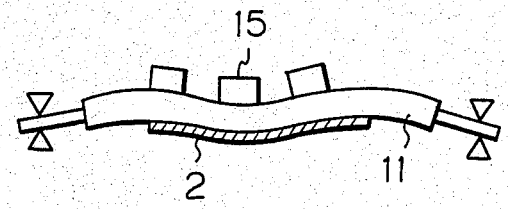
FIG. 14 is a front view showing a modification of the tension leveler of FIG. 13.

Now, the method for forcibly applying widthwise bending to the metal strip will be described in detail. As shown in FIG. 12, it is preferred that the roll distance is increased before and behind the rolls for applying widthwise bending, thereby facilitating the widthwise bending of the metal strip. As a means for applying the widthwise bending, the roll bending described hereinabove may be used. The roll shaft can be deflected either by a hydraulic cylinder, as in a rolling mill, (FIG. 13) or by split back-up rolls 15 (FIG. 14).

Figure 16:
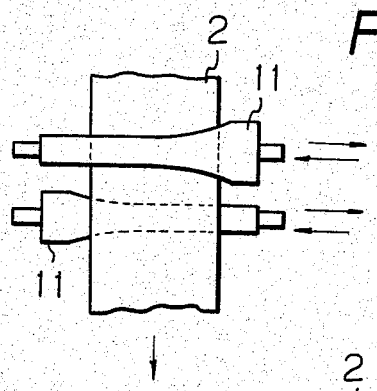
FIG. 16 is a plan view showing a further modification of the tension leveler of FIG. 13.
Figure 15:
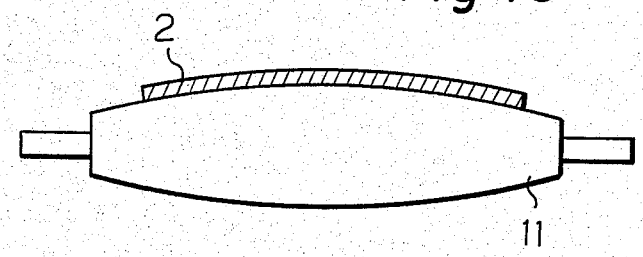
FIG. 15 is a front view showing another modification of the tension leveler of FIG. 13.

Instead of deflecting the roll shaft, a common crowned roll 11 (FIG. 15) may be used. At this time, a variable crown roll (not shown) in which a fluid is supplied to a pressure chamber defined between the arbor and the sleeve to vary the roll crown may be used. Besides, as shown in FIG. 16, at least a pair of the rolls 11 may be provided each with a crown only on one side thereof, said crowns being disposed on opposite sides, and the pair of rolls may be moved axially in opposite directions according to the width of the metal strip.

Figure 17:
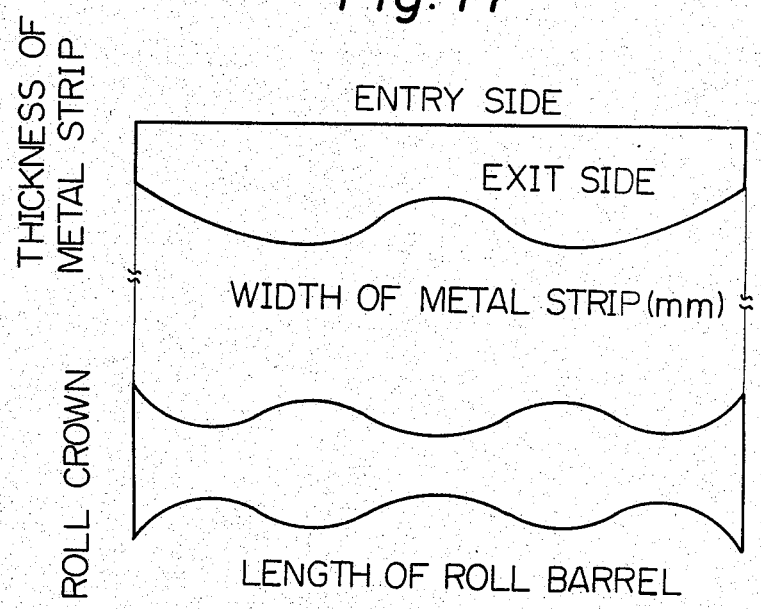
FIG. 17 is a graph showing results of examples of practice of the method according to the present invention.

The experiment using rolls provided with various shaped crowns revealed the below-described facts. The distribution of thickness of the metal strip is varied sharply by the shape of the crown of the roll, for example, whether it is of a convex, concave or complicated wave form, to obtain not only a simple convex or concave crown but also a complicated widthwise distribution of thickness. An example of it is shown in FIG. 17, in which the shapes of rolls are shown exaggeratingly. As a general tendency, the thickness of the metal strip is smaller than normal in a portion in which the roll crown has a convex curvature while it is larger than normal in a portion in which the roll crown has a concave curvature. In a rolling roll, where a crown is provided, the dimension of diameter at respective positions gives direct influence to the thickness distribution on the exit side. In the bending under tension according to the present invention, however, it is a characteristic feature that the thickness distribution on the exit side is directly influenced not by the dimension of the diameter but by the direction of the curvature, namely whether it is convex or concave, and the dimension of the curvature.

As will be clear from the foregoing, the desired distribution of thickness is obtained by giving widthwise bending of a desired widthwise distribution of curvature to the metal strip.

As another significant characteristic feature, it has been made clear that the shape of the metal strip is not much adversely affected by the bending under tension using the rolls provided with crown or bending. It has also been made clear that when the shape of the metal strip on the entry side is insufficient, the thickness distribution is changed and, at the same time, the shape of the metal strip is considerably corrected. Further, even when a certain degree of shape defect occurred in the roll applying widthwise bending to the metal strip because the widthwise bending is large, the shape is corrected as in conventional tension levelers by performing the bending under tension without performing the widthwise bending in the succeeding rolls.

According to the present invention, as described above, it is possible to change the widthwise distribution of thickness while correcting shape defects. This is a very distinctive characteristic feature different from rolling.

In cases where the value of crown or deflection of roll is large, the lengthwise tensile force is small, and the width of the metal strip is large, the metal strip sometimes detaches in some portion from the roll without being kept in close contact with the roll over the entire width, thereby reducing the curvature of the widthwise bending in that portion. In such cases, the effect of the present invention can be increased by making the contact of the metal strip closer using, for example, means shown in FIGS. 18 to 21.

Figure 18:
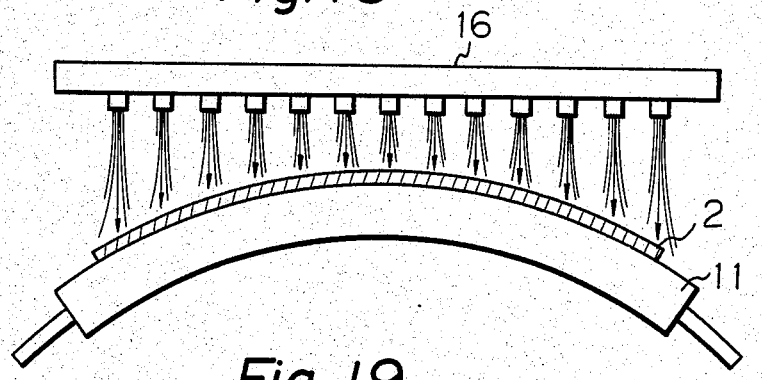
FIG. 18 is a front view showing a schematic construction of a means for preventing detaching of the metal strip.

FIG. 18 shows the means for pushing the metal strip 2 against the roll 11 by means of a nozzle 16 injecting a pressurized fluid such as oil, water, air and the like.

Figure 19:
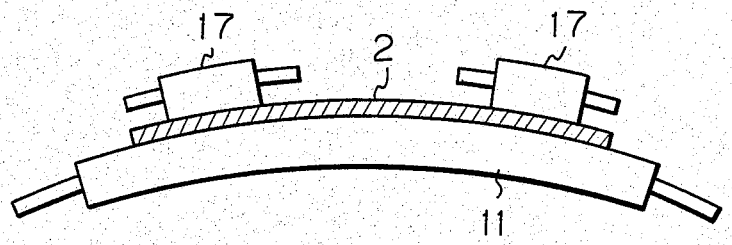
FIG. 19 is a front view similar to FIG. 18, showing a modification of the means for preventing detaching of the metal strip.

FIG. 19 shows the means for pushing the metal strip 2 by means of an adequate number (in the illustrated embodiment, two) of back-up rolls 17.

Figure 20:
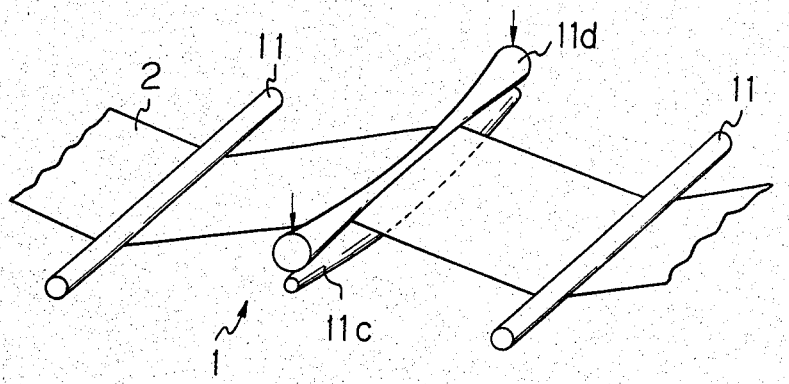
FIG. 20 is a perspective view of another modification of the means for preventing detaching of the metal strip.

FIG. 20 shows the means for holding the metal strip 2 by means of a roll lid which is opposed to a roll 11*c* having a convex crown and has a concave crown complementally fitting therewith.

Figure 21:
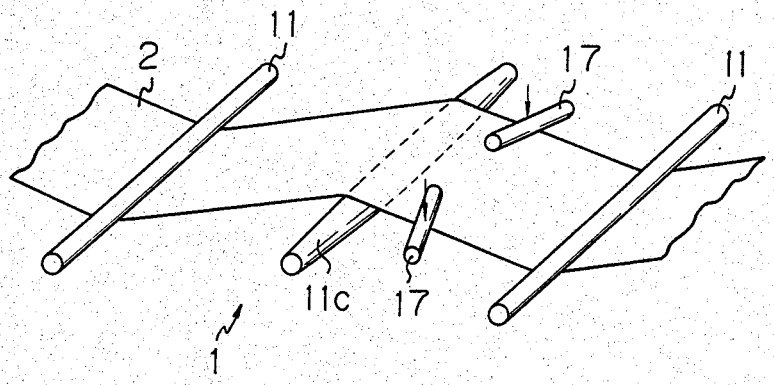
FIG. 21 is a perspective view of a furtehr modification of the means for preventing detaching of the metal strip.

FIG. 21 shows the means for pushing the metal strip 2 by means of similar back-up rolls 17 to that of FIG. 19 disposed on the entry or exit side or on both sides of the crowned leveler roll 11*c*.

While the foregoing description was made with reference to the roll type tension leveler, it will be obvious to those skilled in the art that it applies likewise to stationary block type tension levelers.

Now, the light reduction rolling step will be described in detail. In order to minimize the change in width of the material due to deformation of bending under tension, it is desired to decrease the amount of deformation of the bending under tension to some degree. Further, in order to obtain a large plastic elongation by the bending under tension, the tensile force and the number of the rolls must be increased. In producing a metal strip of a rectangular section, therefore, it is a preferable means to perform light reduction rolling in the preceding step to minimize the widthwise distribution of thickness.

Figure 22:
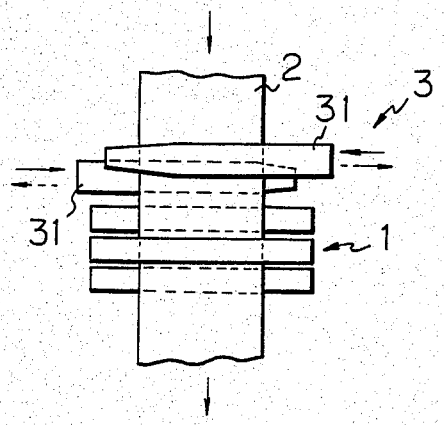
FIG. 22 is a plan view of rolls of a light reduction rolling mill and a tension leveler.

The light reduction rolling is performed either by another line in advance or by a rolling mill disposed on the entry side of the tool train for bending under tension of the same line. In the light reduction rolling, it is preferred, as shown in FIG. 22, to form a crown or a taper on one side of a pair of rolls 31 of the rolling mill, to dispose said crowns or tapers on opposite sides, and to move them axially in opposite directions to each other according to the width of the metal strip, thereby reducing edge drop.

Characteristic features of the light reduction rolling will be described in detail below with reference to results of experiments.

Figure 23:
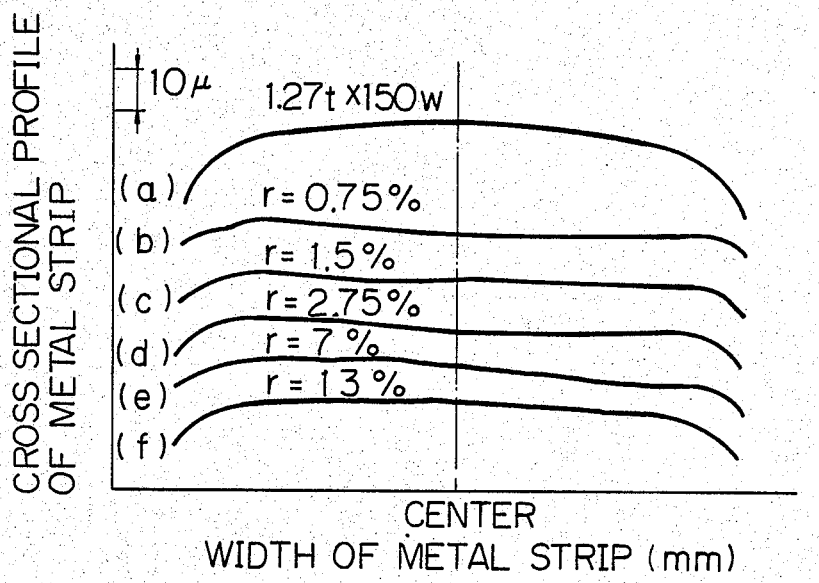
FIG. 23 is a graph showing the relationship between the rate of reduction and the cross-sectional profile of the material in light reduction rolling.

In FIG. 23, curve (a) shows a cross-sectional profile of a hot-rolled material of 1.27 mm thickness and 150 mm width. This material was subjected to light reduction rolling into cross-sectional profiles shown by curves (b) to (f) of FIG. 23, in which reference character $\gamma$ denotes rate of reduction (%). Crown $(CR)_{20}$ and edge drop $(ED)_{20\text{-}2.5}$ of the material with respect to the curves (b) to (f) are shown in FIG. 24.

Figure 24:
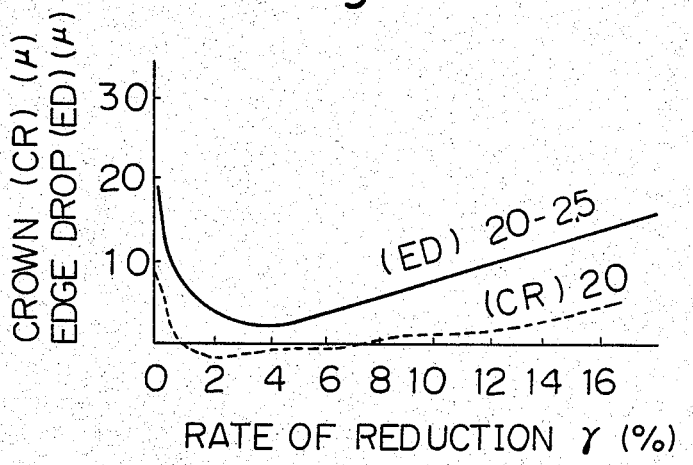
FIG. 24 is a graph showing the relationship between the rate of reduction and the crown and edge drop of the material in light reduction rolling.

As will be clear from FIG. 24, the material crown (CR) and the material edge drop (ED) can be considerably reduced by selecting an adequate value of the rate of reduction $\gamma$. However, this method has a limit because the shape of the material is made extremely worse at this time. Reduction of edge drop is made easy by using also the roll shifting method as shown in FIG. 22.

In order to correct the edge drop and crown left uncorrected through the light reduction rolling step described above and to correct the large shape defect caused in the light reduction rolling, change of thickness distribution and correction of shape defect are performed by the tension leveler described hereinabove.

As will be clear from the foregoing explanation, in the method according to the present invention it is possible to combine the widthwise bending step and the light reduction rolling step besides the step of the bending under tension.

Figure 25A:
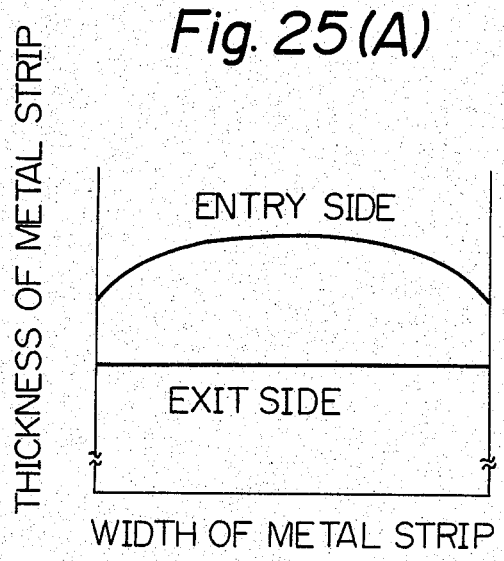
FIGS. 25A and 25B are graphs showing examples of change of the widthwise distribution of thickness of the metal strip; and, FIGS. 26 to 29 are schematic block diagrams illustrating the method according to the present invention.
Figure 25B:
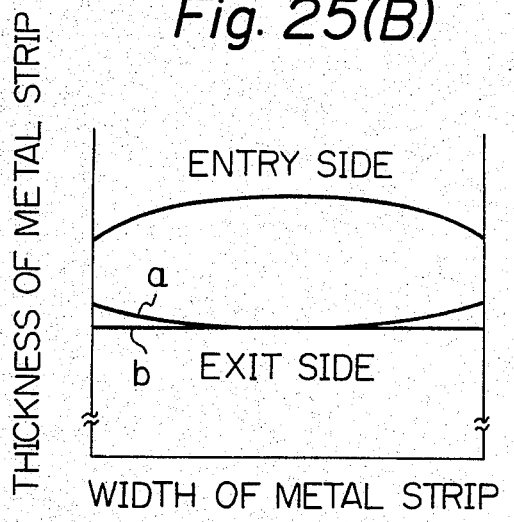

In the case where the widthwise distribution of thickness on the entry side or other factors vary, it is possible to make the widthwise distribution of thickness on the exit side constant by regulating one or more of the means employed in the method according to the present invention. For example, in the case where the sheet crown on the entry side varies, the sheet crown on the exit side can be made constant by regulating the value of widthwise bending. FIGS. 25A and 25B show an example of it. That is, FIG. 25A shows that since the sheet crown on the entry side is large, the value of bending of the roll is increased to thereby obtain a substantially uniform distribution of thickness on the exit side. However, in the case where the sheet crown on the entry side varies and decreases as shown in FIG. 25B, the same value of bending as in FIG. 25A produces excessive correction as shown by curve a in FIG. 25B, the value of bending is reduced to reduce the widthwise bending, to thereby obtain a substantially uniform thickness distribution as shown by curve b in FIG. 25B. In this case, either of two means are possible, in one of which the thickness distribution on the exit side is measured by an instrument disposed on the exit side and the measured value is fedback to control the widthwise bending and in the other of which the thickness distribution on the entry side is measured and the control is performed by feedforward.

Figure 26:
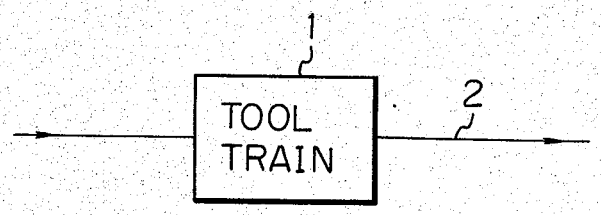

To summarize, the basic method according to the present invention is to pass the metal strip 2 through the tool train 1 as shown in FIG. 26, to thereby apply the bending under tension to the metal strip 2 and to produce the lengthwise plastic elongation of the metal strip 2.

A first modification is to apply widthwise bending to the metal strip concurrently with the bending under tension.

Figure 27:
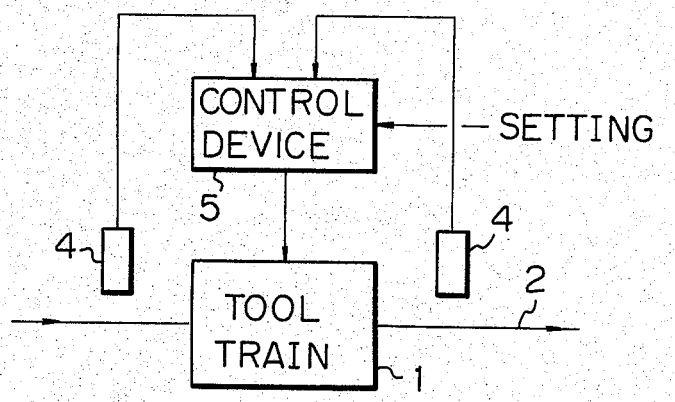

In a second modification a thickness meter 4 is disposed on the entry or exit side or on both the sides of the tool train 1, as shown in FIG. 27, to measure the widthwise distribution of thickness of the metal strip 2, the measured value is applied to a control device 5 for comparison with the command, and a control signal is applied to the tool train 1 to regulate the lengthwise plastic elongation or the curvature of widthwise bending of the metal strip 2 or both of them. The thickness meters 4 and/or the control device 5 illustrated in FIG. 27 may be of any known type such as those disclosed in U.S. Pat. No. 3,228,219 issued Jan. 11, 1966 to Fox.

Figure 28:
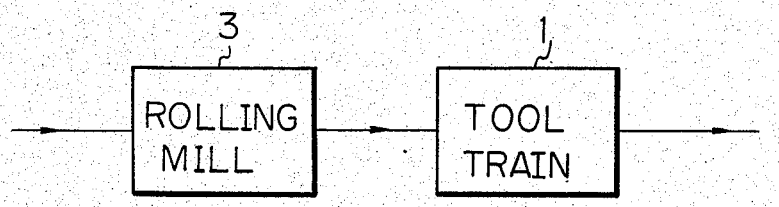
Figure 29:
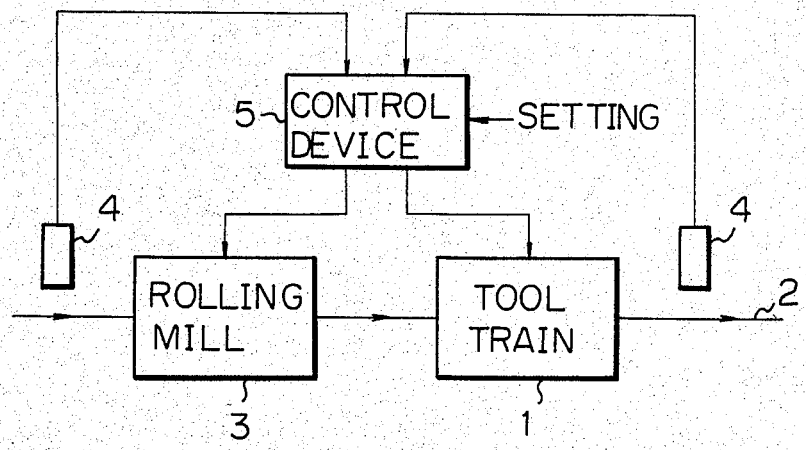

In a third modification, a rolling mill 3 is disposed, as shown in FIG. 28, on the entry side of the tool train 1 to apply light reduction rolling to the metal strip and, thereafter, the metal strip is subjected only to the bending under tension or both of the bending under tension and the widthwise bending concurrently by the tool train 1.

In a fourth modification, similarly to the second modification, the thickness meter 4 is disposed on the entry side of the rolling mill 3 or on the exit side of the tool train 1 or on both of them, to measure the widthwise distribution of thickness of the metal strip 2, the measured value is applied to the control device 5 for comparison with the command, a control signal is applied to the tool train 1 or the rolling mill 3 or both of them to regulate the lengthwise elongation of the metal strip 2, the curvature of the widthwise bending, or the rate of reduction of the light reduction rolling, or combination of them.

While we have described the method according to the present invention mainly with respect to the case where the metal strip is at ordinary temperatures, it will be obvious to those skilled in the art that the method according to the present invention is applied sufficiently effectively to a metal strip at high temperatures since the higher in temperature the material becomes, the greater plastic elongation of it is obtained with low tensile force. For example, the method according to the present invention can be effectively applied to hot rolling lines, continuous annealing lines, zinc-coating lines, and the like.

Obviously many other modifications and variations of the present invention are possible in the light of the above teachings. It is therefore to be understood that within the scope of the appended claims the invention may be practiced otherwise than as specifically described.

What is claimed is:

1. A method for changing a widthwise distribution of thickness of a metal strip, comprising the steps of:

passing the metal strip through a tool train including a plurality of tools disposed in zigzag; and applying a bending under tension to said metal strip in the lengthwise direction thereof when passing through said tool train to provide said metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train.

2. A method as set forth in claim 1, characterized in that said tool is a roll.

3. A method as set forth in claim 1, characterized in that said tool is a stationary block.

4. A method as set forth in claim 1, characterized in that said tool is a stationary block designed to inject a pressurized fluid from the top thereof.

5. A method for changing a widthwise distribution of thickness of a metal strip, comprising the steps of:

passing the metal strip through a tool train including a plurality of tools disposed in zigzag;

applying a bending under tension to said metal strip in the lengthwise direction thereof when passing through said tool train to provide said metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train;

measuring the distribution of thickness of the metal strip on at least one of the entry and the exit sides of the tool train; and regulating the lengthwise plastic elongation of the metal strip according to the measured value.

6. A method for changing a widthwise distribution of thickness of a metal strip, comprising the steps of:

passing the metal strip through a tool train including a plurality of tools disposed in zigzag;

applying a bending under tension to said metal strip in the lengthwise direction thereof when passing through said tool train to provide said metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train; and applying a widthwise bending to said metal strip concurrently with said bending under tension when passing through said tool train.

7. A method as set forth in claim 6, characterized in that said widthwise bending of the metal strip is performed by forming a crown in at least one of the tools of said tool train.

8. A method as set forth in claim 6, characterized in that said widthwise bending of the metal strip is performed by pushing a back-up member against at least one of the tools of said tool train to thereby deflect said tool.

9. A method as set forth in claim 6, characterized in that said widthwise bending of the metal strip is performed by forming a crown only on one side of at least a pair of tools of said tool train, disposing said crowns on opposite sides, and moving said pair of tools axially in opposite directions.

10. A method as set forth in claim 6, characterized in that a pushing member is disposed on the opposite side of at least one tool of said tool train with respect to the metal strip, and the metal strip is pushed against said tool.

11. A method as set forth in claim 10, characterized in that said pushing member is a roll.

12. A method as set forth in claim 10, characterized in that said pushing member is a nozzle for injecting a pressurized fluid.

13. A method as set forth in claim 10, characterized in that said pushing member is a stationary block.

14. A method as set forth in claim 10, characterized in that said pushing member is a stationary block designed to inject a pressurized fluid from the top thereof.

15. A method for changing a widthwise distribution of thickness of a metal strip, comprising the steps of:

passing the metal strip through a tool train including a plurality of tools disposed in zigzag;

applying a bending under tension to said metal strip in the lengthwise direction thereof when passing through said tool train to provide said metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train;

applying a widthwise bending to said metal strip concurrently with said bending under tension when passing through said tool train;

measuring the distribution of thickness of the metal strip on at least one of the entry and the exit sides of the tool train; and regulating at least one of the lengthwise plastic elongation and the widthwise bending of the metal strip according to the measured value.

16. A method for changing a widthwise distribution of thickness of a metal strip, comprising the steps of:

passing the metal strip through a tool train including a plurality of tools disposed in zigzag;

applying a bending under tension to said metal strip in the lengthwise direction thereof when passing through said tool train to provide said metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train; and forming a desired curvature at each desired widthwise position of the metal strip during said widthwise bending.

17. A method as set forth in claim 16, characterized in that said widthwise bending of the metal strip is performed by forming a predetermined crown in at least one of the tools of said tool train.

18. A method as set forth in claim 16, characterized in that said widthwise bending of the metal strip is performed by pushing a back-up member against at least one of the tools of said tool train to thereby deflect said tool.

19. A method as set forth in claim 16, characterized in that said widthwise bending of the metal strip is performed by forming a crown only on one side of at least a pair of tools of said tool train, disposing said crowns on opposite sides, and moving said pair of tools axially in opposite directions.

20. A method as set forth in claim 16, characterized in that pushing member is disposed on the opposite side of at least one tool of said tool train with respect to the metal strip, and the metal strip is pushed against said tool.

21. A method as set forth in claim 20, characterized in that said pushing member is a roll.

22. A method as set forth in claim 20, characterized in that said pushing member is a nozzle for injecting a pressurized fluid.

23. A method as set forth in claim 20, characterized in that said pushing member is a stationary block.

24. A method as set forth in claim 20, characterized in that said pushing member is a stationary block designed to inject a pressurized fluid from the top thereof.

25. A method for changing a widthwise distribution of thickness of a metal strip, comprising the steps of:

applying a light reduction rolling to the metal strip by rolling rolls;

passing the metal strip through a tool train including a plurality of tools disposed in zigzag after said light reduction rolling; and applying a bending under tension to the metal strip in the lengthwise direction thereof when passing through said tool train to provide the metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train.

26. A method as set forth in claim 25, characterized in that said light reduction rolling is applied to the metal strip by forming a crown only on one side of at least a pair of rolls of said rolling rolls, disposing said crowns on opposite sides, and moving said pairs of rolling rolls axially in opposite directions.

27. A method as set forth in claim 25, characterized in that said light reduction rolling is applied to the metal strip by forming a taper only on one side of at least a pair of rolls of said rolling rolls, disposing said tapers on opposite sides, and moving said pair of rolling rolls axially in opposite directions.

28. A method for changing a widthwise distribution of thickness of a metal strip, comprising the steps of:

applying a light reduction rolling to the metal strip by rolling rolls;

passing the metal strip through a tool train including a plurality of tools disposed in zigzag after said light reduction rolling;

applying a bending under tension to the metal strip in the lengthwise direction thereof when passing through said tool train to provide the metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train;

measuring the distribution of thickness of the metal strip on at least one of the entry side of said rolling rolls and the exit side of said tool train; and regulating at least one of the lengthwise plastic elongation of the metal strip and the rate of reduction of the light reduction rolling, according to the measured value.

29. A method for changing a widthwise distribution of thickness of a metal strip, comprising the steps of:

applying a light reduction rolling to the metal strip by rolling rolls;

passing the metal strip through a tool train including a plurality of tools disposed in zigzag after said light reduction rolling;

applying a bending under tension to the metal strip in the lengthwise direction thereof when passing through said tool train to provide the metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train; and applying a widthwise bending to the metal strip concurrently with said bending under tension when passing through said tool train.

30. A method as set forth in claim 29, characterized in that a desired curvature is formed at each desired widthwise position of the metal strip during said widthwise bending.

31. A method for changing a widthwise distribution of thickness of a metal strip, comprising the steps of:

applying a light reduction rolling to the metal strip by rolling rolls;

passing the metal strip through a tool train including a plurality of tools disposed in zigzag after said light reduction rolling;

applying a bending under tension to the metal strip in the lengthwise direction thereof when passing through said tool train to provide the metal strip with a lengthwise plastic elongation so determined that the difference between the maximum decrease in the thickness and the minimum decrease in the thickness of the metal strip is equal to or larger than 0.5% of the maximum thickness of the metal strip on an entry side of said tool train;

applying a widthwise bending to the metal strip concurrently with said bending under tension when passing through said tool train;

measuring the distribution of thickness of the metal strip on at least one of the entry side of said rolling rolls and the exit side of said tool train; and regulating at least one of the lengthwise plastic elongation of the metal strip, the widthwise bending of the metal strip and the rate of reduction of said light reduction rolling, according to the measured value.

* * * * *